US012392565B2

(12) United States Patent
Jeon

(10) Patent No.: US 12,392,565 B2
(45) Date of Patent: Aug. 19, 2025

(54) HEADER TANK OF HEAT EXCHANGER

(71) Applicant: Hanon Systems, Daejeon (KR)

(72) Inventor: Young-Ha Jeon, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 155 days.

(21) Appl. No.: 18/266,352

(22) PCT Filed: Jan. 27, 2022

(86) PCT No.: PCT/KR2022/001474
§ 371 (c)(1),
(2) Date: Jun. 9, 2023

(87) PCT Pub. No.: WO2022/169202
PCT Pub. Date: Aug. 11, 2022

(65) Prior Publication Data

US 2024/0044591 A1 Feb. 8, 2024

(30) Foreign Application Priority Data

Feb. 2, 2021 (KR) ..... 10-2021-0014917

(51) Int. Cl.
*F28F 9/02* (2006.01)
*F28D 1/053* (2006.01)

(52) U.S. Cl.
CPC ..... *F28F 9/0246* (2013.01); *F28D 1/05391* (2013.01)

(58) Field of Classification Search
CPC ..... F28F 9/0246; F28D 1/05391
See application file for complete search history.

(56) References Cited

U.S. PATENT DOCUMENTS 5,086,835 A * 2/1992 Shinmura ..... F28F 9/0246 123/41.51
5,176,200 A * 1/1993 Shinmura ..... F28F 9/262 165/144
5,529,116 A * 6/1996 Sasaki ..... F28D 1/0435 165/145

(Continued)

FOREIGN PATENT DOCUMENTS

JP 2002213840 A 7/2002
JP 2014228240 A 12/2014

(Continued)

OTHER PUBLICATIONS

International Search Report issued in PCT/KR2022/001474 on May 13, 2022.

*Primary Examiner* — Raheena R Malik
(74) *Attorney, Agent, or Firm* — NORTON ROSE FULBRIGHT US LLP

(57) ABSTRACT

The present invention relates to a header tank provided in a heat exchanger having a two-row structure in which core parts are provided in two rows, and to a header tank having a structure in which a first tank is coupled to a header, and a second tank is coupled to be spaced apart from the first tank at a predetermined interval, such that condensate water condensed on surfaces of the core parts may be discharged between the first tank and the second tank, thereby satisfying all of pressure resistance of the header tank, temperature distribution of the core parts, and cooling performance of the heat exchanger.

14 Claims, 10 Drawing Sheets

(56) References Cited

U.S. PATENT DOCUMENTS 5,582,239 A * 12/1996 Tsunoda ..... F28D 1/05341 29/890.052
9,494,368 B2 * 11/2016 Jindou ..... F28F 9/02
10,495,361 B2 * 12/2019 Max ..... F24F 3/14
10,627,165 B2 * 4/2020 Seo ..... F28F 9/0214
12,044,479 B2 * 7/2024 Ma ..... F28F 9/268
2003/0066633 A1 * 4/2003 Lee ..... F28D 1/05391 165/175
2006/0054310 A1 * 3/2006 Kim ..... F25B 39/02 165/110
2006/0054312 A1 * 3/2006 Kim ..... F28D 1/05391 165/146
2007/0144715 A1 * 6/2007 Ohashi ..... F28D 1/05391 165/176
2007/0209386 A1 9/2007 Higashiyama et al.
2009/0025914 A1 * 1/2009 Knight ..... F28D 1/05391 165/174
2013/0312453 A1 * 11/2013 Jeon ..... F28F 9/26 62/524
2013/0312454 A1 * 11/2013 Jeon ..... F28F 9/0207 62/524
2014/0069136 A1 * 3/2014 Lim ..... B60H 1/00778 62/436
2014/0124183 A1 * 5/2014 Hwang ..... F25B 39/00 165/173
2014/0311702 A1 * 10/2014 Takagi ..... F28F 9/028 165/41
2016/0223265 A1 * 8/2016 Jindou ..... F28D 1/0476
2017/0138675 A1 * 5/2017 Lu ..... F28D 1/05366
2018/0073809 A1 * 3/2018 Seo ..... F28F 19/00
2020/0200492 A1 * 6/2020 Dolderer ..... F28F 9/0273
2024/0044591 A1 * 2/2024 Jeon ..... F28D 1/05391

FOREIGN PATENT DOCUMENTS

KR 20000034194 A 6/2000
KR 101139809 B1 4/2012
KR 20120035798 A 4/2012
KR 101344521 B1 12/2013

* cited by examiner

HEADER TANK OF HEAT EXCHANGER

CROSS REFERENCE TO RELATED APPLICATIONS

This patent application is a national phase under 35 U.S.C. § 371 of International Patent Application No. PCT/KR2022/001474 filed Jan. 27, 2022, which claims the benefit of priority from Korean Patent Application No. 10-2021-0014917 filed Feb. 2, 2021, each of which is hereby incorporated herein by reference in its entirety for all purposes.

TECHNICAL FIELD

The present invention relates to a header tank of a heat exchanger, and more specifically, to a header tank provided in a heat exchanger having a two-row structure in which core parts are provided in two rows, the header tank having a structure in which a first tank is coupled to a header, and a second tank is coupled to be spaced apart from the first tank at a predetermined interval, such that condensate water condensed on surfaces of the core parts may be discharged between the first tank and the second tank, thereby satisfying all of pressure resistance of the header tank, temperature distribution of the core parts, and cooling performance of the heat exchanger.

BACKGROUND ART

An air conditioning device for a vehicle refers to an internal device for a vehicle installed for the purpose of cooling or heating a vehicle interior in the summer or winter season or ensuring front and rear visual fields for a driver by removing frost or the like formed on a windshield in rainy or cold weather. The air conditioning device typically has both a heating system and a cooling system and cools, heats, or ventilates the vehicle interior by selectively introducing outside air or inside air, heating or cooling the air, and then blowing the air into the vehicle interior.

A general refrigeration cycle of the air conditioning device includes an evaporator configured to absorb heat from the periphery, a compressor configured to compress a refrigerant, a condenser configured to discharge heat to the periphery, and an expansion valve configured to expand the refrigerant. In the refrigeration cycle of the cooling system, a gaseous refrigerant, which is introduced into the compressor from the evaporator, is compressed into a high-temperature, high-pressure refrigerant by the compressor, and the compressed gaseous refrigerant is liquefied while passing through the condenser, such that liquefaction heat is discharged to the periphery. The liquefied refrigerant is converted into low-temperature, low-pressure wet saturated vapor while passing through the expansion valve again. Thereafter, the refrigerant is introduced into the evaporator again and cools ambient air by absorbing vaporization heat from the periphery while being vaporized. Therefore, the vehicle interior is cooled by this process.

The condenser, the evaporator, and the like used in the cooling system are representative heat exchangers. There have been many consistent research efforts to create more effective heat exchange between the air outside the heat exchanger and a heat exchange medium in the heat exchanger, i.e., the refrigerant. The efficiency of the evaporator has the most direct effect on the cooling of the vehicle interior. Therefore, various types of structural research and development have been particularly carried out to improve the heat exchange efficiency of the evaporator.

One of the improved structures to improve the heat exchange efficiency of the evaporator is an evaporation structure having a two-row structure in which cores including tubes and fins are doubly provided to define first and second rows that are spaces in which the refrigerant flows. FIG. 1 is an exploded perspective view of an evaporator having a two-row structure in the related art. As illustrated, in an evaporator 2 having a two-row structure in the related art, a header tank 3 disposed at an upper side and a header tank 4 disposed at a lower side are provided in two rows by being partitioned by a partition wall. The connect first and second rows a1 and a2 provided to constitute flow paths in which a refrigerant flows, a communication hole 6 may be formed in a partition wall 5 that partitions the first and second rows a1 and a2.

However, because the header tank does not have a drain hole at a portion corresponding to a position between the first row and the second row, there is a problem in that condensate water, which is created on refrigerant tubes and fins that constitute the evaporator, is hardly discharged smoothly during the heat exchange.

DOCUMENT OF RELATED ART (Patent Document 1) Korean Patent No. 1344521 (Dec. 17, 2013)

DISCLOSURE

Technical Problem

The present invention has been made in an effort to solve the above-mentioned problem, and an object of the present invention is to provide a header tank or a structure thereof, which is a header tank provided in a heat exchanger having a two-row structure in which core parts are provided in two rows, the header tank having a structure in which a first tank is coupled to a header, and a second tank is coupled to be spaced apart from the first tank at a predetermined interval, such that condensate water condensed on surfaces of the core parts may be discharged between the first tank and the second tank.

Another object of the present invention is to provide a header tank having a structure capable of satisfying all of pressure resistance of the header tank, temperature distribution of air discharged from a heat exchanger, and cooling performance of the heat exchanger.

Technical Solution

A header tank according to an example of the present invention is provided in a heat exchanger having a two-row structure including a first-row tube and a second-row tube spaced apart from each other at a predetermined interval in a width direction and includes: a header provided at one end of the first-row tube and one end of the second-row tube based on a longitudinal direction and including a first header part coupled to one end of the first-row tube, a second header part coupled to one end of the second-row tube, and a header central part configured to connect the first header part and the second header part; a first tank coupled to the first header part to define a first internal space; a second tank spaced apart from the first tank at a predetermined interval and coupled to the second header part to define a second internal space; and a plurality of communication pipes provided between the first tank and the second tank and configured to allow the first internal space and the second internal space to communicate with each other, in which the plurality of communication pipes is disposed to be spaced apart from one another at predetermined intervals in the width direction.

The header tank may be provided at a lower side of the heat exchanger, and condensate water may be discharged between the first and second tanks spaced apart from each other and between the communication pipes spaced apart from one another.

The header central part may have a plurality of through-holes formed through the header central part and spaced apart from one another at predetermined intervals, and the condensate water may be discharged through the plurality of through-holes.

The communication pipes may each have a circular shape.

An upper outer edge of the first tank, which connects an outer side surface and an upper surface of the first tank, may be formed in a rounded shape, and an upper outer edge of the second tank, which connects an outer side surface and an upper surface of the second tank, may be formed in a rounded shape.

A plurality of first ribs, which is indented toward the inside of the first internal space, may be formed on the upper outer edge of the first tank and spaced apart from one another at predetermined intervals in the width direction, and a plurality of second ribs, which is indented toward the inside of the second internal space, may be formed on the upper outer edge of the second tank and spaced apart from one another at predetermined intervals in the width direction.

An upper inner edge of the first tank, which connects the upper surface and an inner side surface of the first tank, may be formed in a right-angled shape, and an upper inner edge of the second tank, which connects the upper surface and an inner side surface of the second tank, may be formed in a right-angled shape.

A central portion of a lower surface of the first header part based on the width direction may have a rounded shape curved toward the first-row tube, and a central portion of a lower surface of the second header part based on the width direction may have a rounded shape curved toward the second-row tube.

First support insertion holes may be formed at two opposite ends of a lower surface of the first header part based on the width direction, first supports protruding from a core part housing of the heat exchanger in a direction of the first header part may be fixedly inserted into the first support insertion holes, second support insertion holes may be formed at two opposite ends of a lower surface of the second header part based on the width direction, and second supports protruding from the core part housing of the heat exchanger in a direction of the second header part direction may be fixedly inserted into the second support insertion holes.

The communication pipes may each be formed by coupling first and second pipes separated from each other, the first pipe may be integrated with the first tank and protrude in a direction from the first tank toward the second tank, and the second pipe may be integrated with the second tank and protrude in a direction from the second tank toward the first tank.

The first and second pipes may be symmetric to each other, and an end of the first pipe and an end of the second pipe may be in contact with each other.

A cross-sectional area of the first pipe may be larger than a cross-sectional area of the second pipe, a length of the first pipe may be longer than a length of the second pipe, and the second pipe may be inserted into the first pipe.

Cross-sectional areas of communication holes formed in the communication pipes may be equal to one another.

Cross-sectional areas of communication holes formed in the communication pipes may gradually increase in a direction from a communication pipe positioned at one end based on the width direction to a communication pipe positioned at the other end based on the width direction.

A coolant cooler according to another aspect of the present invention may include the header tank.

Advantageous Effects

According to the present invention, the first tank and the second tank are coupled to each other on the header and spaced apart from each other at a predetermined interval, such that condensate water on the surface of the core part may be discharged between the first and second tanks spaced apart from each other. The condensate water may be completely discharged to the outside of the heat exchanger through the through-hole formed in the central part of the header. Therefore, it is possible to ensure excellent drainage performance.

In addition, the upper outer edges of the first and second tanks are formed in a rounded shape, and the rib structure, which is indented inward, is applied to the edge, such that the pressure resistance of the header tank may significantly increase.

EXPLANATION OF REFERENCE NUMERALS AND SYMBOLS

10: Heat exchanger

20: Core part

Figure 1:
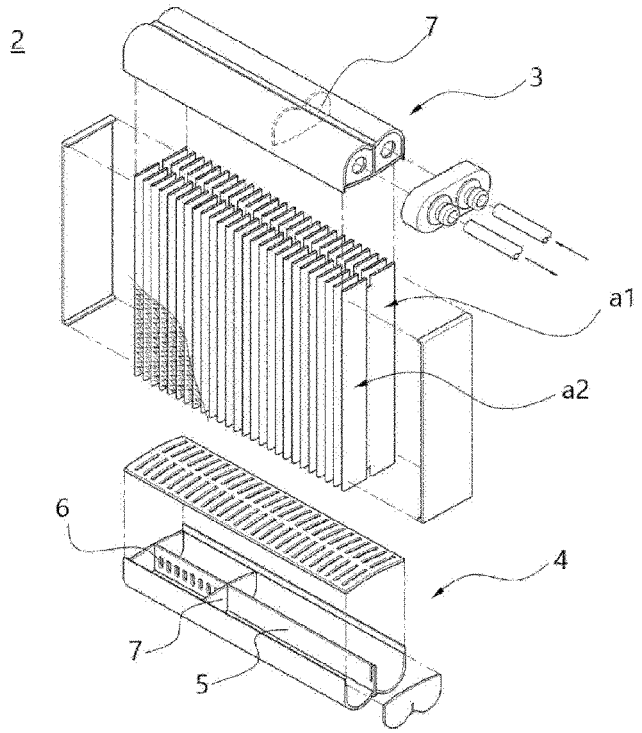
FIG. 1 is an exploded perspective view of an evaporator having a two-row structure in the related art.

30: Header tank
100: Header
110: First header part
120: Second header part
130: Header central part
200: First tank
290: First rib
300: Second tank
390: Second rib
400: Communication pipe
400A: First pipe
400B: Second pipe

BEST MODE

Hereinafter, the present invention will be described with reference to the accompanying drawings.

Figure 2:
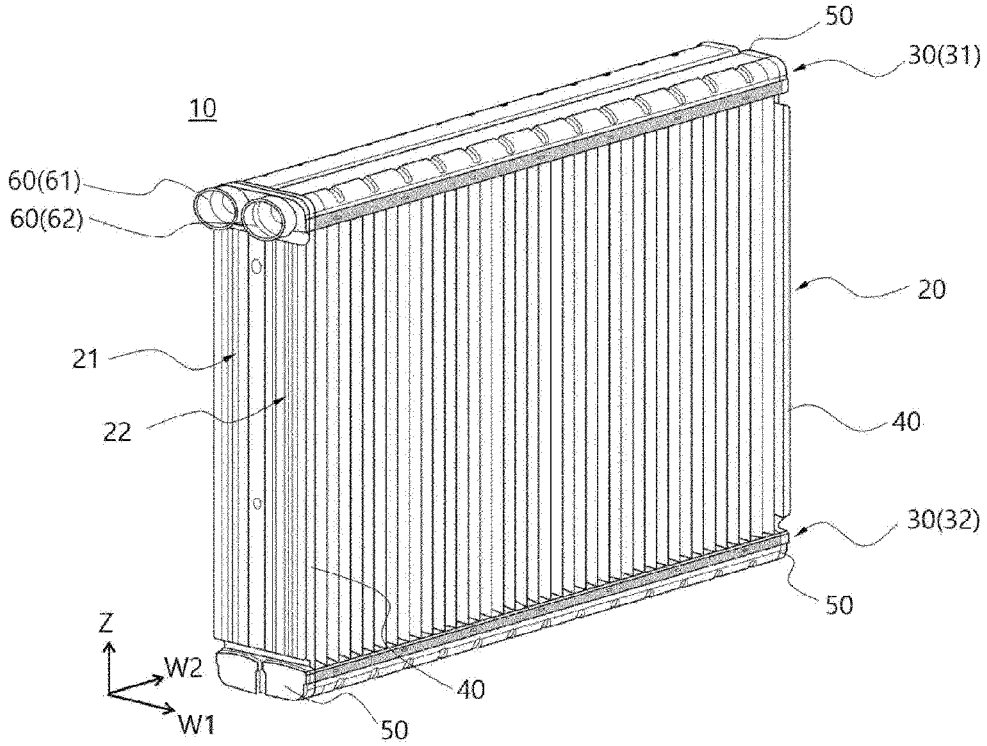
FIG. 2 is a perspective view of an entire heat exchanger according to an example of the present invention.

FIG. 2 is a perspective view of an entire heat exchanger according to an example of the present invention. A heat exchanger 10 of the present invention may be a heat exchanger having a two-row structure in which first and second row tubes spaced apart from each other at a predetermined interval in a width direction W1. As illustrated, the heat exchanger 10 of the present invention may broadly include core parts 20 positioned at a central portion, and upper and lower header tanks 31 and 32 respectively provided at upper and lower sides of the core parts. In FIG. 2, Z indicates a height direction of the heat exchanger, and W1 and W2 respectively indicate width directions of the heat exchanger.

The core part 20 defines a region in which a working fluid (e.g., a refrigerant, a coolant, or a third working fluid, hereinafter, referred to as a 'refrigerant'), which flows in the heat exchanger, concentratedly exchanges heat with outside air. In general, the core part may include a plurality of tubes in which the refrigerant flows, and a plurality of fins interposed between the tubes. The present invention relates to the heat exchanger having the two-row structure in which the core parts 20 are provided in two rows. A first-row core part 21 and a second-row core part 22 are provided to be spaced apart from each other at a predetermined interval in the width direction W1. Therefore, the first-row core part 21 may include first-row tubes 21T provided as a plurality of tubes disposed in the width direction W2, and a plurality of fins interposed therebetween. The second-row core part 22 may include second-row tubes 22T provided as a plurality of tubes disposed in the width direction W2, and a plurality of fins interposed therebetween.

The header tanks 30 are respectively provided at the upper and lower sides of the core parts 20. For example, the upper header tank 31 may receive the refrigerant from the outside and transfer the refrigerant to the tubes of the core parts. The lower header tank 32 may receive the refrigerant, which has performed heat exchange while passing through the tubes of the upper header tank 31, and discharge the refrigerant to the outside.

Further, core part housings 40, which are structures for supporting the core parts 20, may be further provided at two opposite sides of the core part 20 based on the width direction W2. End caps 50 may be provided at two opposite sides of the header tank 30 in the width direction and define an internal space by closing ends of the header tank 30. Refrigerant ports 60 may be further provided on at least one of the two opposite sides of the header tank 30 based on the width direction and include a refrigerant inlet port 61 through which the refrigerant is introduced into the header tank from the outside, and a refrigerant discharge port 62 through which the refrigerant is discharged to the outside from the inside of the header tank.

Figure 3:
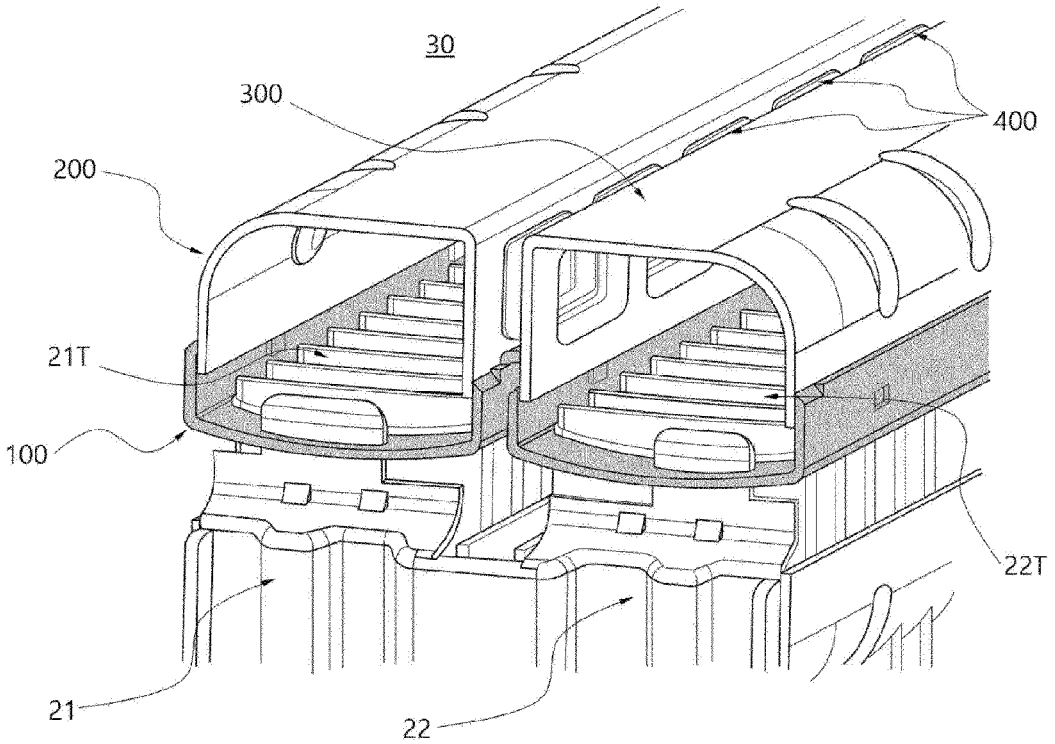
FIG. 3 is a perspective view of a header tank according to the example of the present invention.
Figure 4:
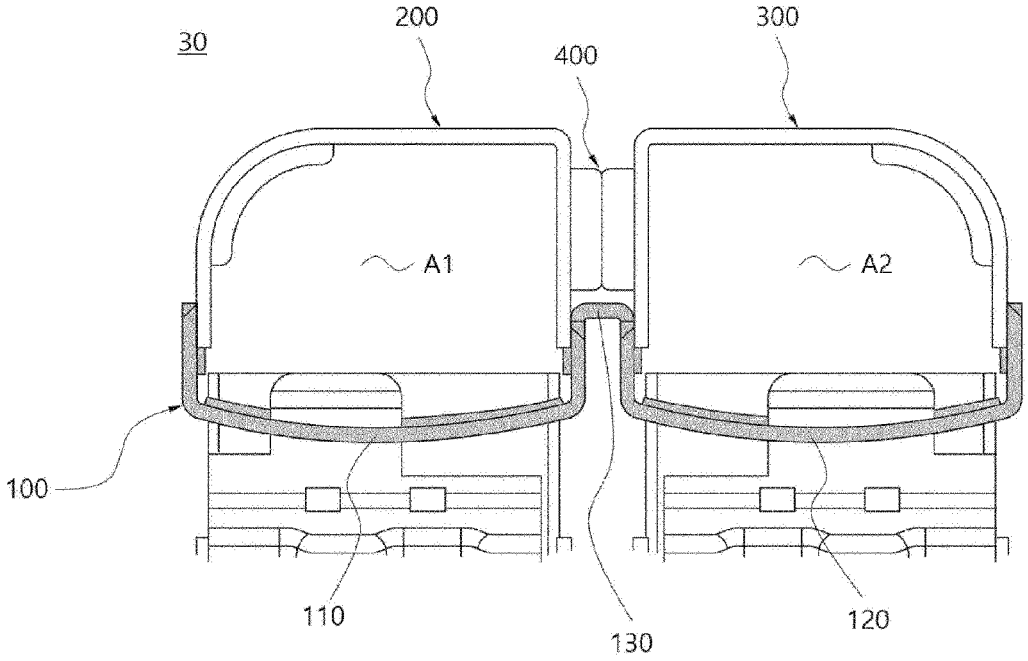
FIG. 4 is a front view of the header tank according to the example of the present invention.

FIG. 3 is a perspective view of the header tank according to the example of the present invention, and FIG. 4 is a front view of the header tank according to the example of the present invention. FIGS. 3 and 4 respectively illustrate the header tank 30 provided at the upper side of the first-row core part 21 and the second-row core part 21. As illustrated, the header tank 30 of the present invention may include a header 100, a first tank 200, a second tank 300, and communication pipes 400 provided between the first tank 200 and the second tank 300.

The header 100 is provided at one end of the first-row tube 21T of the first-row core part 21 and one end of the second-row tube 22T of the second-row core part 22 based on the longitudinal direction. The header 100 may include a first header part 110 coupled to one end of the first-row tube 21T, a second header part 120 coupled to one end of the second-row tube 22T, and a header central part 130 configured to connect the first header part 110 and the second header part 120. In this case, one end based on the longitudinal direction may correspond to the upper or lower side of the core part 20. Hereinafter, for convenience of description, the description will be focused on the header tank provided at the upper side. The header tank provided at the lower side will be separately described when necessary.

Figure 5:
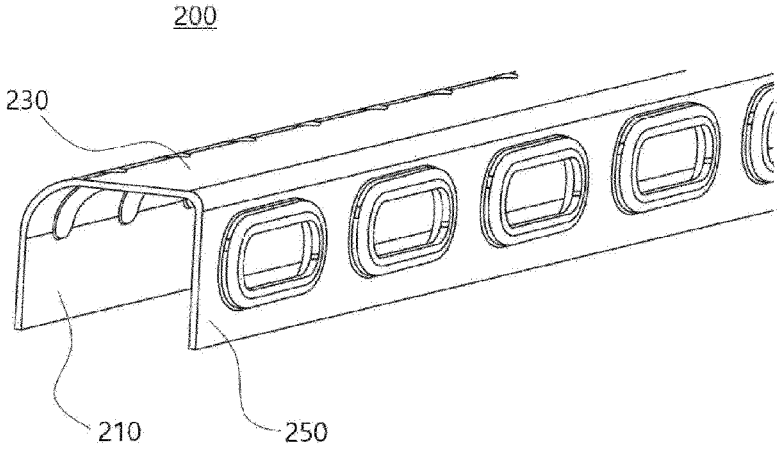
FIG. 5 is a perspective view of a first tank according to the example of the present invention.

The first tank 200 is coupled to the first header part 110 to define a first internal space 1A. The first tank 200 may be shaped such that an upper surface and two opposite surfaces, which are provided at two opposite sides of the upper surface, surround the first header part. FIG. 5 is a perspective view of the first tank according to the example of the present invention. As illustrated, the first tank 200 may have a structure including an outer side surface 210, an upper surface 230, and an inner side surface 250.

The second tank 300 is coupled to the second header part 120 to define a second internal space 2A and disposed to be spaced apart from the first tank 200 at a predetermined interval. Like the first tank, the second tank 300 may include an outer side surface 310, an upper surface 330, and an inner side surface 350.

The communication pipe 400 serves to allow the first internal space 1A, which is defined by the header 100 and the first tank 200, and the second internal space 2A, which is defined by the header 100 and the second tank 300, to communicate with each other. The communication pipe 400 may be provided as a plurality of communication pipes 400 provided between the first tank 200 and the second tank 300. In this case, the plurality of communication pipes 400 may be disposed to be spaced apart from one another at predetermined intervals in the width direction W2.

In the present invention as described above, unlike a configuration in the related art in which a header tank provided in a heat exchanger having a two-row structure generally includes a single header and a header tank coupled to the single tank and a partition wall provided in the header tank divides an internal space into two spaces, the header tank 30 of the present invention includes the header 100, which is provided as one piece, and the first and second tanks 200 and 300, which are provided as two pieces, such that the internal spaces 1A and 2A may be formed to be separated from each other by the tanks 200 and 300. Further, the header tank 30 may have the structure in which the first tank 200 and the second tank 300 are spaced apart from each other at a predetermined interval, the plurality of communication pipes 400 is provided between the first and second tanks 200 and 300, which are spaced apart from each other, and allows the first tank 200 and the second tank 300 to communicate with each other, and the communication pipes 400 are disposed to be spaced apart from one another in the width direction.

That is, in the present invention, the first tank 200 and the second tank 300 are spaced apart from each other in the width direction, the plurality of communication pipes 400 is provided between the first tank 200 and the second tank 300, and the communication pipes 400 are disposed to be spaced apart from one another in the width direction, such that a gap may be formed between the first tank 200 and the second tank 300. Therefore, according to the present invention, in case that the header tank 30 is provided at the lower side of the core part, condensate water, which is condensed on surfaces of the pipes and fins by the heat exchange in the core part, may be discharged through the gap formed between the first tank and the second tank.

In this case, the communication pipes 400 may each have a circular shape. Therefore, even though condensate water falls onto the communication pipe 400, the condensate water may fall downward along a curved surface of the communication pipe by gravity without remaining on the communication pipe. Therefore, it is possible to further improve efficiency in discharging condensate water in the heat exchanger.

Figure 6:
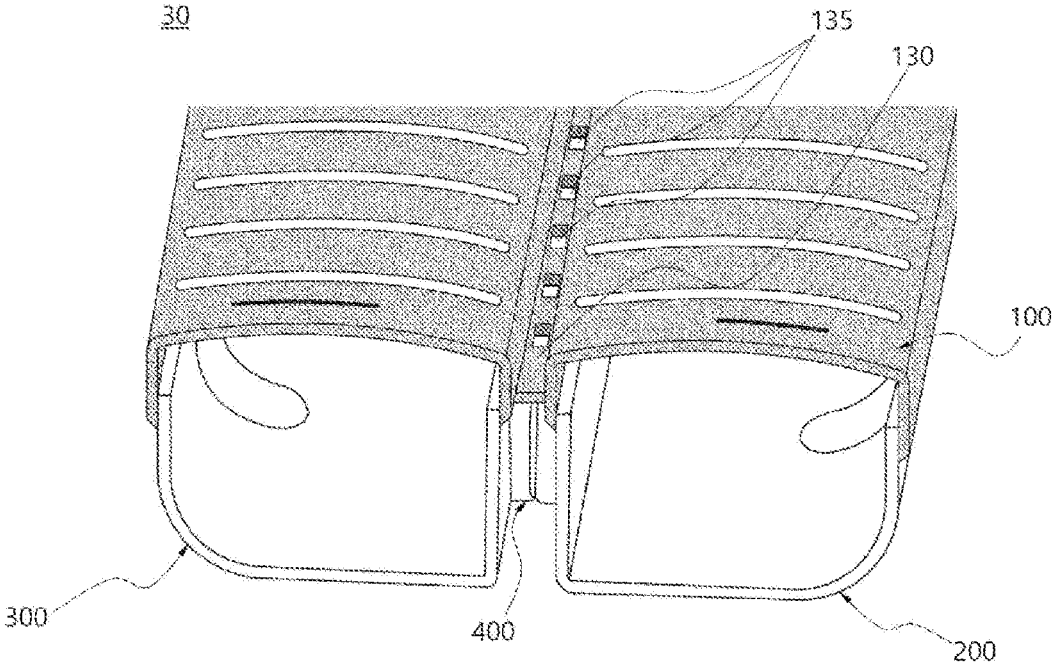
FIG. 6 is a perspective view of the header tank according to the example of the present invention when viewed from below.

Meanwhile, in case that the header tank 30 is provided at the lower side of the core part, the condensate water, which is discharged while passing between the first tank 200 and the second tank 300, meets the header 100 positioned below the first and second tanks 200 and 300. In this case, in the present invention, a plurality of through-holes 135 is formed through the header central part 130 of the header 100 so as to penetrate the header central part 130 in an upward/downward direction and spaced apart from one another at predetermined intervals in the width direction W2, such that condensate water may be completely discharged to the outside of the heat exchanger through the through-holes 135. FIG. 6 is a perspective view of the header tank according to the example of the present invention when viewed from below. As illustrated, the plurality of through-holes 135 may be formed in the header central part 130 and spaced apart from one another at predetermined intervals in the width direction W2. Therefore, condensate water, which falls onto the header central part while passing through the first tank and the second tank, may be completely discharged to the lower side of the heat exchanger.

As described above, the present invention provides the heat exchanger having the two-row structure with the structure capable of efficiently discharging condensate water, which is created in the core part of the heat exchanger, to the outside of the heat exchanger. Therefore, it is possible to solve a problem that may occur when condensate water remains in the heat exchanger, particularly between the header tanks without being discharged to the outside of the heat exchanger.

Hereinafter, specific structures of the header, the tank, and the communication pipe, which are the constituent elements of the header tank of the present invention, will be described.

Figure 7:
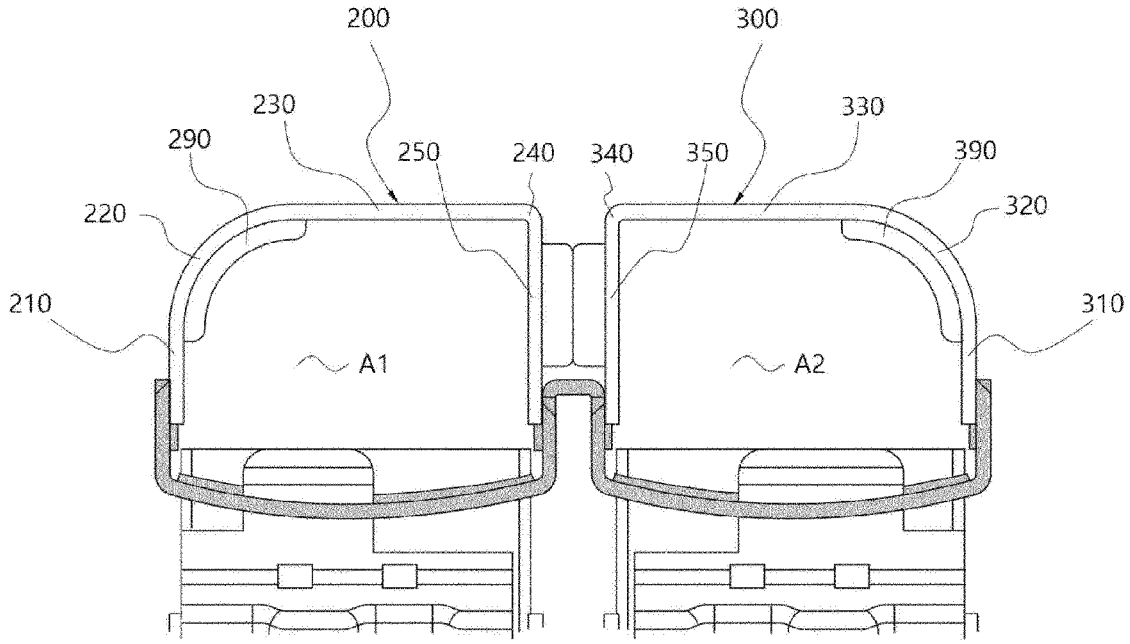
FIG. 7 is a view illustrating FIG. 4 again.

First, the tank of the present invention will be described in more detail. FIG. 7 is a view illustrating FIG. 4 again. The first tank 200 may include the outer side surface 210, the upper surface 230, and the inner side surface 250. In this case, an upper outer edge 220, which connects the outer side surface 210 and the upper surface 230 of the first tank, may be formed in a rounded shape. Like the first tank, the second tank 300 may include the outer side surface 310, the upper surface 330, and the inner side surface 350 of the second tank. Like the first tank, an upper outer edge 320, which connects the outer side surface 310 and the upper surface 330 of the second tank, may be formed in a rounded shape. Because the upper outer edges 220 and 320 of the first and second tanks 200 and 300 are formed in a rounded shape, pressure resistance of the first and second tanks may be improved. Therefore, it is possible to reduce thicknesses of the first and second tanks and define a maximally large internal space in the header tank.

Figure 8:
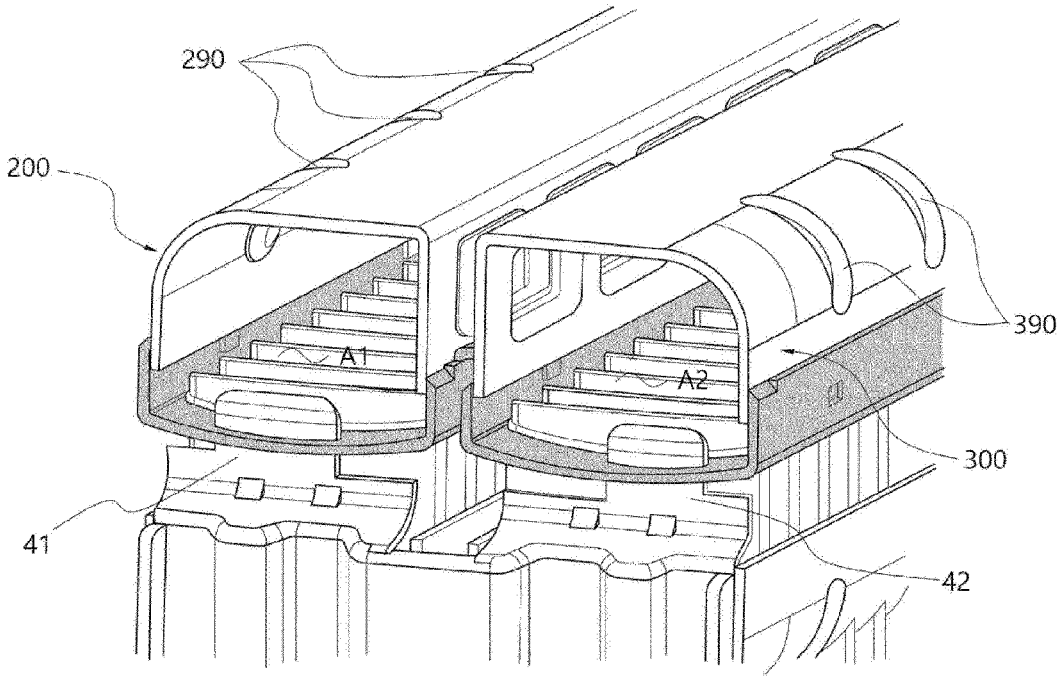
FIG. 8 is a view illustrating FIG. 3 again.

In addition, in the present invention, rib structures may be further applied to the first and second tanks to further improve the pressure resistance of the first and second tanks. More specifically, FIG. 8 is a view illustrating FIG. 3 again. A plurality of first ribs 290 may be formed on the upper outer edge 220 of the first tank 200 and spaced apart from one another at predetermined intervals in the width direction, and the first rib 290 may be indented toward the inside of the first internal space 1A. Like the first tank, the second tank 300 may also have a plurality of second ribs 390 formed on the upper outer edge 320 of the second tank 300. This is to ensure structural rigidity of the tank by indenting a predetermined region of the upper outer edge inward in case that the upper outer edge is formed in a circularly rounded shape. Therefore, it is possible to further improve the pressure resistance of the first and second tanks.

In addition, with reference to FIGS. 7 and 8, an upper inner edge 240, which connects the upper surface 230 and the inner side surface 250 of the first tank 200, is formed in a right-angled shape. Like the first tank, the second tank 300 may also have an upper inner edge 340 that is formed in a right-angled shape and connects the upper surface 330 and the inner side surface 350 of the second tank 300. In this case, the right-angled shape has a physical meaning and of course means that two surfaces substantially define a right angle without meaning the perpendicular. Because the upper inner edges of the first and second tanks are each formed in a right-angled shape as described above, it is possible to maximize sizes of the first and second internal spaces defined by coupling the header and the first and second tanks. Therefore, it is possible to maximally ensure a refrigerant accommodation capacity in the header tank within a limited space.

Figure 9:
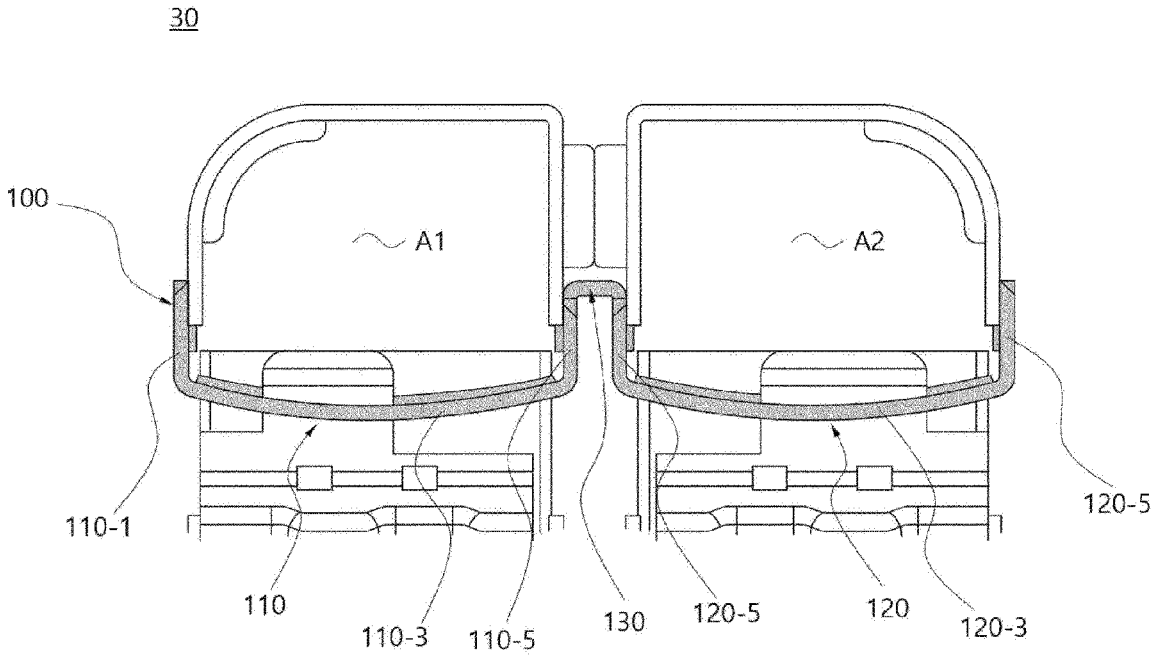
FIG. 9 is a view illustrating FIG. 4 again.

Next, the header of the present invention will be described in more detail. FIG. 9 is a view illustrating FIG. 4 again. The header 100 of the present invention may be provided as one piece and have the structure in which the first header part 110, the central part 130, and the second header part 120 are connected. The first header part 110 may include an outer side surface 110-1, a lower surface 110-3, and an inner side surface 110-5. Like the first header part, the second header part 120 may also include an outer side surface 120-1, a lower side surface 120-3, and an inner side surface 120-5.

In this case, as illustrated, the lower surface 110-3 of the first header part 110 may have a central portion based on the width direction, and the central portion may have a rounded shape curved toward the first-row tube. Like the first header part, the lower surface 120-3 of the second header part 120 may have a central portion based on the width direction, and the central portion may have a rounded shape curved toward the second-row tube. Further, the lower surface 110-3 of the first header part may have first-row tube insertion holes 115 into which the tubes of the first-row tubes are respectively inserted. Like the first header part, the lower surface 120-3 of the second header part may have second tube insertion holes 125 into which the tubes of the second-row tubes are respectively inserted.

In case that the lower surface of the header is formed in a rounded shape as described above, a folded type tube using a rolling material may be smoothly inserted into the header. Because the tubes penetrate the insertion holes formed in the header and communicate with the internal space of the header tank, coupling properties between the tubes and the header tank may be improved.

Figure 10:
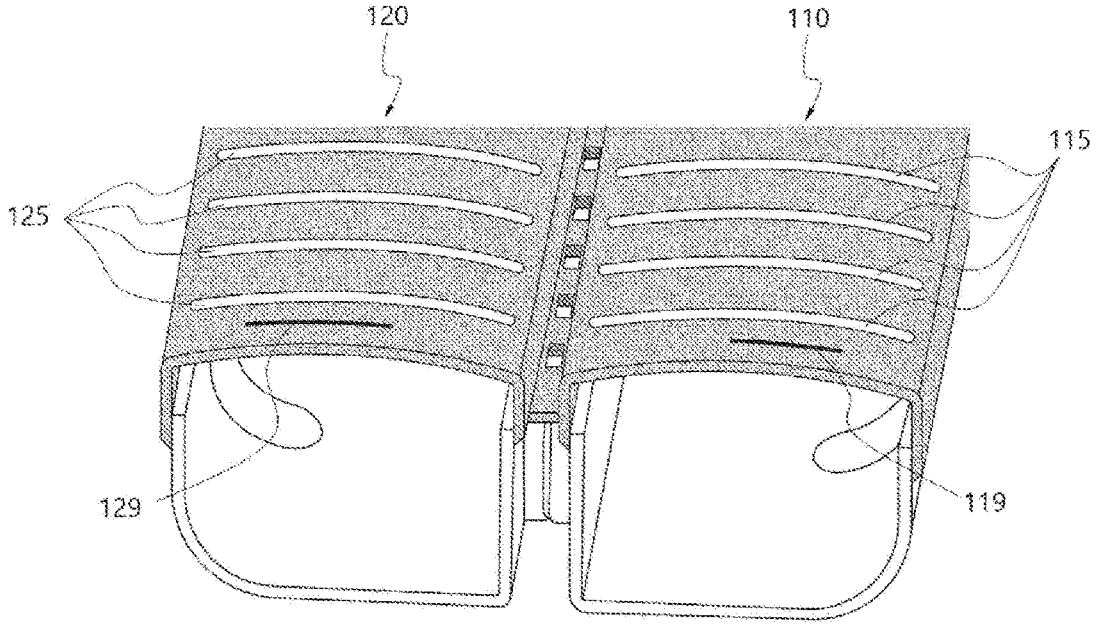
FIG. 10 is a view illustrating FIG. 6 again.

In addition, in the header part of the present invention, first support insertion holes 119 may be formed at two opposite ends of the lower surface 110-3 of the first header part based on the width direction W2, and first supports 41 protruding from the core part housing in the direction of the first header part may be fixedly inserted into the first support insertion holes 119. Like the first header part, second support insertion holes 129 may be formed at two opposite ends of the lower surface 120-3 of the second header part based on the width direction, and second supports 42 protruding from the housing in the direction of the second header part may be fixedly inserted into the second support insertion holes 129. Therefore, it is possible to strongly support the core part by increasing a coupling force between the core part and the header tank and minimize a degree to which the core part is separated from the header tank or deformed in position by external impact or the like. FIG. 10 is a view illustrating FIG. 6 again and illustrating the tube insertion holes 115 and 125 and the support insertion holes 119 and 129.

Figure 11:
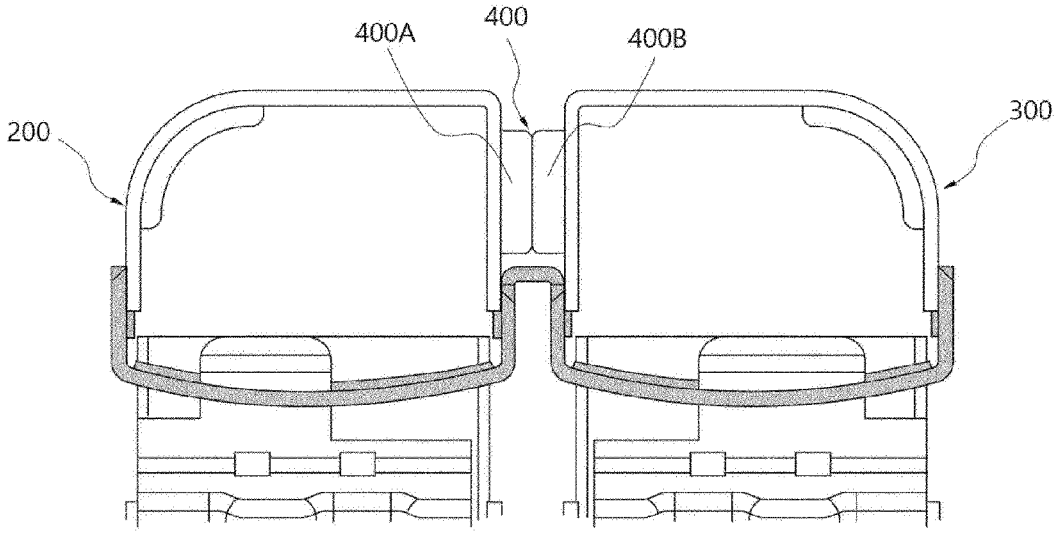
FIG. 11 is a view illustrating FIG. 4 again.
Figure 12:
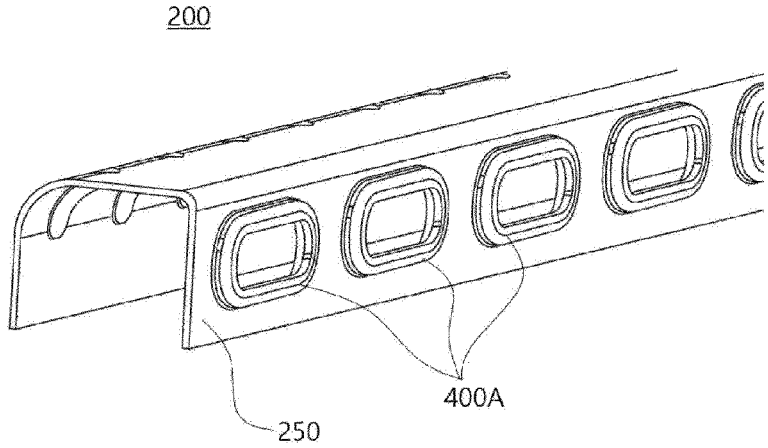
FIG. 12 is a view illustrating FIG. 5 again.

Next, the communication pipe 400 of the present invention will be described in more detail. FIG. 11 is a view illustrating FIG. 4 again, and FIG. 12 is a view illustrating FIG. 5 again. The plurality of communication pipes 400 in the present invention is each configured by coupling first and second pipes 400A and 400B that are separated from each other. In this case, the first pipe 400A may be integrated with the first tank and protrude in a direction from the first tank toward the second tank. The second pipe 400B may be integrated with the second tank and protrude in a direction from the second tank toward the first tank. The first and second pipes 400A and 400B may each have a hollow shape and be structured to communicate with each other through communication holes respectively formed in the inner side surface 250 of the first tank and the inner side surface 350 of the second tank.

In this case, the first pipe 400A and the second pipe 400B may be symmetric to each other. As illustrated in FIG. 11, the communication pipe 400 may be provided as an end of the first pipe 400A and an end of the second pipe 400B are in contact with each other. For example, the symmetric shape may mean that the first and second pipes are identical in shape and length. Because the first and second pipes are symmetric to each other as described above, the first and second tanks may be manufactured to have the same shape, which may improve manufacturability.

Alternatively, a cross-sectional area of the first pipe 400A may be larger than a cross-sectional area of the second pipe 400B, and a length of the first pipe 400A may be longer than a length of the second pipe 400B, such that the communication pipes 400 of the present invention may each be formed by inserting and coupling the second pipe 400B into the first pipe 400A. Because the first pipe and the second pipe are different in shape from each other, the first tank and the second tank need to be separately manufactured, which may somewhat cause a loss in terms of manufacturability. However, the structure in which the first pipe and the second pipe are coupled by insertion may increase a coupling force between the first tank and the second tank. Further, there is an advantage in that a separate structure for coupling the first tank and the second tank may be excluded, which may reduce the number of coupling components and the number of coupling processes in terms of the entire heat exchanger.

Figure 13:
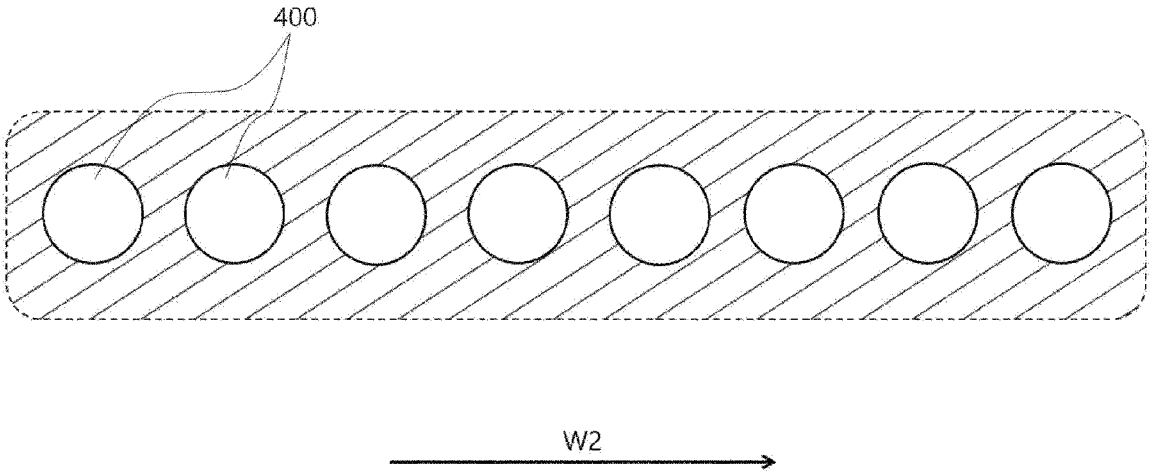
FIG. 13 is a view illustrating lateral cross-sections of communication pipes according to the example of the present invention.

Meanwhile, in the present invention, the communication holes formed in the communication pipes 400 may have the same cross-sectional area. That is, FIG. 13 is a view illustrating lateral cross-sections of the communication pipes according to the example of the present invention. As illustrated, the cross-sectional areas of all the communication holes in the communication pipes disposed side by side in a direction from one side to the other side may be equal to one another.

Figure 14:
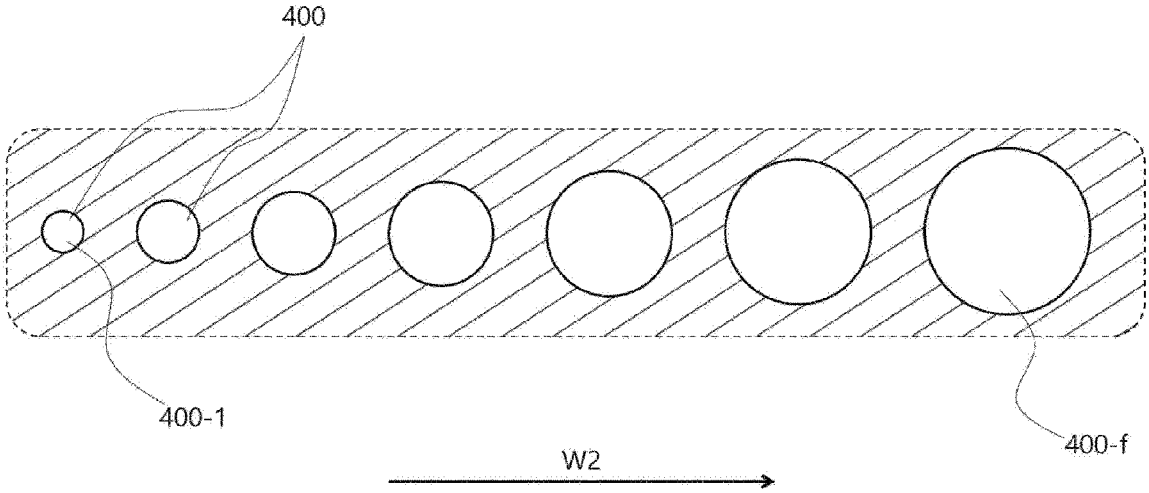
FIG. 14 is a view illustrating lateral cross-sections of communication pipes according to another example of the present invention.

Alternatively, the cross-sectional areas of the communication holes formed in the communication pipes 400 may gradually increase in a direction from a communication pipe 400-1, which is positioned at one end based on the width direction, to a communication pipe 400-*f* positioned at the other end based on the width direction W2. FIG. 14 is a view illustrating lateral cross-sections of communication pipes according to another example of the present invention. As illustrated, the cross-sectional areas of the communication pipes may gradually increase in the direction from one side to the other side based on the width direction W2. Because the refrigerant is introduced through the refrigerant inlet port, the amount of refrigerant becomes larger and the pressure of the refrigerant becomes higher as the distance from the refrigerant inlet port decreases. Therefore, the refrigerant needs to be transferred toward the side opposite to and distant from the refrigerant inlet port, i.e., from one side to the other side in the header tank so that the refrigerant may uniformly pass through the core part. Therefore, as the heat exchange area of the core part increases, the heat exchange efficiency of the heat exchanger may increase. To this end, in the present invention, an area of the communication hole of the communication pipe close to the refrigerant inlet port is small, and an area of the communication hole of the communication pipe distant from the refrigerant inlet port is large, such that a circulation area of the refrigerant may increase, which may efficiently distribute the refrigerant in the heat exchanger.

Figure 15:
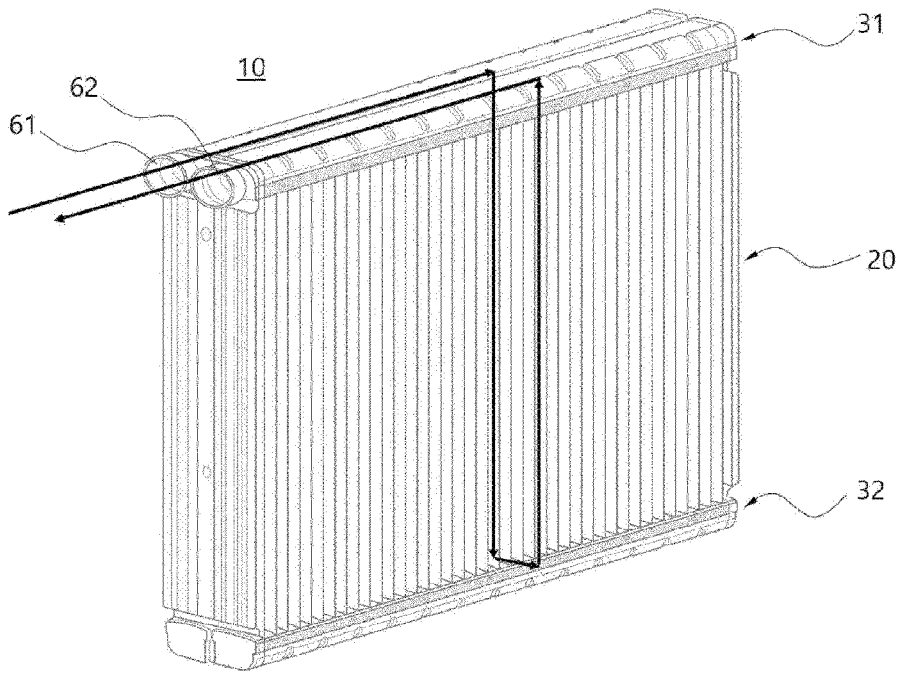
FIG. 15 is a view illustrating a refrigerant flow path of the heat exchanger according to the example of the present invention.

FIG. 15 is a view illustrating a refrigerant flow path in the heat exchanger according to the example of the present invention. As illustrated, the refrigerant may be introduced into the first internal space of the upper header tank 31 from the outside through the refrigerant inlet port 61 provided at one side of the upper header tank 31, and the refrigerant introduced into the first internal space may pass through the first-row tube of the core part 20 and then be introduced into the first internal space of the lower header tank 32. The refrigerant introduced into the first internal space of the lower header tank 32 may be introduced into the second internal space of the lower header tank 32 through the communication pipe of the lower header tank 32, and the refrigerant introduced into the second internal space of the lower header tank 32 may pass through the second-row tube of the core part 20 and then be introduced into the second internal space of the upper header tank 31. The refrigerant introduced into the second internal space of the upper header tank 31 may be discharged to the outside through the refrigerant discharge port 62 provided at one side of the upper header tank 31. In this case, although not illustrated separately, in case that the upper header tank 31 has the refrigerant inlet port and the refrigerant discharge port as described in the above-mentioned example, the communication pipe of the upper header tank 31 may, of course, have a structure having the closed inside.

Hereinafter, a coolant cooler according to another aspect of the present invention will be described.

Figure 16:
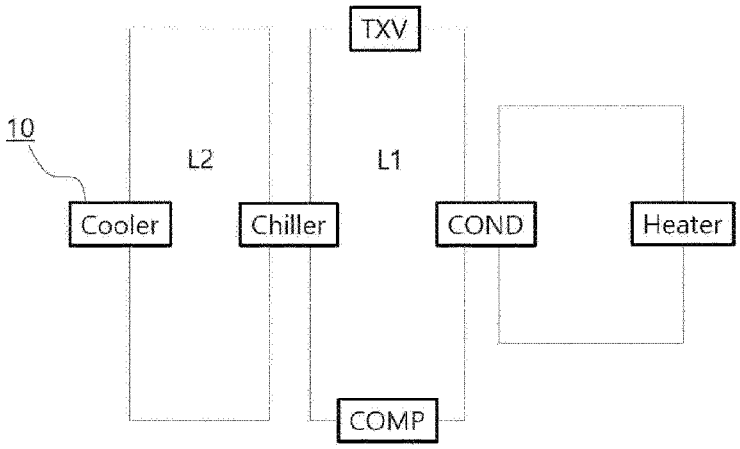
FIG. 16 is a view illustrating an example of a secondary loop cooling system.

The heat exchanger of the present invention may be a coolant cooler used for a secondary loop cooling system that has been studied recently. FIG. 16 is a view illustrating an example of a secondary loop cooling system. The secondary loop cooling system may include a refrigerant circulation line L1, and a coolant line L2 that cools an interior by using a coolant that exchanges heat with a refrigerant in a refrigerant circulation line. The coolant cooler may serve to cool air by using the cold coolant disposed in the coolant line L2. In this case, the present invention provides the coolant cooler disposed in the secondary loop cooling system, and the coolant cooler may include the above-mentioned header tank 30 of the present invention. More specifically, the coolant cooler may be a coolant cooler in which the header tank 30 is provided on at least one of the upper and lower sides of the core part of the coolant cooler.

In the case of the secondary loop cooling system, a temperature difference between inlet side air introduced into the coolant cooler and the coolant introduced into the coolant cooler under a cooling condition does not exceed 40 degrees. In the case of a hot water heater in a refrigerant cooling system in the related art, a temperature difference between the inlet side air and the refrigerant introduced into the heater is 70 degrees or more, such that sufficient heat dissipation performance may be provided even though the heater has a small heat exchange area. However, in the case of the secondary loop cooling system, the coolant cooler may provide a sufficient heat exchange area and a sufficient flow path length because of a relatively small temperature difference condition. The core part may have a multi-row structure to increase the flow path length. However, in case that the multi-row structure has three or more rows, an excessive amount of pressure drop at a coolant side may decrease the flow rate and the amount of heat dissipation. To appropriately satisfy the condition, the heat exchanger may have a two-row structure. Therefore, the heat exchanger of the present invention may have two-row structure as described above. In particular, in case that the heat exchanger is the coolant cooler, the coolant cooler may also have the two-row structure.

In this case, the coolant cooler of the present invention may exclude a baffle (see reference numeral 7 in FIG. 1) that partitions the header tank internal space in the header tank and guides a flow of the refrigerant. That is, no baffle may be applied to the first and second internal spaces of the header tank of the present invention. Because a temperature of the coolant gradually increases as the coolant exchanges heat with air while passing through the cooler, a coolant inlet port region having a lowest temperature and a coolant port region having a highest temperature may overlap each other in case that a flow path of the two-row structure having no baffle is applied. Therefore, it is possible to uniformize the temperature distribution of the outlet side air discharged from the coolant cooler after exchanging heat with the coolant cooler.

Further, as described above, because of the small temperature difference condition in the secondary loop cooling system, the coolant cooler needs to have a sufficient heat exchange area. Therefore, the coolant cooler needs to be manufactured to have a larger size than the heater that is the coolant heat exchanger in the related art. In this case, because the fluidity of the coolant flowing in the coolant cooler increases, the coolant cooler needs to have high pressure resistance. To this end, as described above, in the cooling module of the present invention, the upper outer edge of each of the tanks is formed in a rounded shape, and the ribs are applied, such that the header tank with the ensured pressure resistance is applied. Therefore, the coolant cooler of the present invention may ensure the sufficient pressure resistance, such that the coolant cooler may be manufactured to have a large size. Therefore, it is possible to ensure the cooling performance at a level equal to that of the evaporator in the related art. Further, because the coolant flow path of the two-row structure having no baffle is applied, it is possible to ensure effective temperature distribution of the coolant in the core part.

While the embodiments of the present invention have been described with reference to the accompanying drawings, those skilled in the art will understand that the present invention may be carried out in any other specific form without changing the technical spirit or an essential feature thereof. Therefore, it should be understood that the above-described embodiments are illustrative in all aspects and do not limit the present invention.

What is claimed is:

1. A header tank, which is provided in a heat exchanger having a two-row structure comprising a first-row tube and a second-row tube spaced apart from each other at a predetermined interval in a width direction, the header tank comprising:

a header provided at one end of the first-row tube and one end of the second-row tube based on a longitudinal direction and comprising a first header part coupled to one end of the first-row tube, a second header part coupled to one end of the second-row tube, and a header central part configured to connect the first header part and the second header part;

a first tank coupled to the first header part to define a first internal space;

a second tank spaced apart from the first tank at a predetermined interval and coupled to the second header part to define a second internal space; and a plurality of communication pipes provided between the first tank and the second tank and configured to allow the first internal space and the second internal space to communicate with each other, wherein the plurality of communication pipes is disposed to be spaced apart from one another at predetermined intervals in the width direction, wherein the communication pipes are each formed by coupling first and second pipes separated from each other, the first pipe is integrated with the first tank and protrudes in a direction from the first tank toward the second tank, and the second pipe is integrated with the second tank and protrudes in a direction from the second tank toward the first tank.

2. The header tank of claim 1, wherein the header tank is provided at a lower side of the heat exchanger, and condensate water is discharged between the first and second tanks spaced apart from each other and between the communication pipes spaced apart from one another.

3. The header tank of claim 2, wherein the header central part has a plurality of through-holes formed through the header central part and spaced apart from one another at predetermined intervals, and the condensate water is discharged through the plurality of through-holes.

4. The header tank of claim 2, wherein the communication pipes each have a circular shape.

5. The header tank of claim 1, wherein an upper outer edge of the first tank, which connects an outer side surface and an upper surface of the first tank, is formed in a rounded shape, and an upper outer edge of the second tank, which connects an outer side surface and an upper surface of the second tank, is formed in a rounded shape.

6. The header tank of claim 5, wherein a plurality of first ribs, which is indented toward the inside of the first internal space, is formed on the upper outer edge of the first tank and spaced apart from one another at predetermined intervals in the width direction, and a plurality of second ribs, which is indented toward the inside of the second internal space, is formed on the upper outer edge of the second tank and spaced apart from one another at predetermined intervals in the width direction.

7. The header tank of claim 5, wherein an upper inner edge of the first tank, which connects the upper surface and an inner side surface of the first tank, is formed in a right-angled shape, and an upper inner edge of the second tank, which connects the upper surface and an inner side surface of the second tank, is formed in a right-angled shape.

8. The header tank of claim 1, wherein a central portion of a lower surface of the first header part based on the width direction has a rounded shape curved toward the first-row tube, and a central portion of a lower surface of the second header part based on the width direction has a rounded shape curved toward the second-row tube.

9. The header tank of claim 1, wherein the first and second pipes are symmetric to each other, and an end of the first pipe and an end of the second pipe are in contact with each other.

10. The header tank of claim 1, wherein a cross-sectional area of the first pipe is larger than a cross-sectional area of the second pipe, a length of the first pipe is longer than a length of the second pipe, and the second pipe is inserted into the first pipe.

11. The header tank of claim 1, wherein cross-sectional areas of communication holes formed in the communication pipes are equal to one another.

12. The header tank of claim 1, wherein cross-sectional areas of communication holes formed in the communication pipes gradually increase in a direction from a communication pipe positioned at one end based on the width direction to a communication pipe positioned at the other end based on the width direction.

13. A coolant cooler comprising the header tank of claim 1.

14. A header tank, which is provided in a heat exchanger having a two-row structure comprising a first-row tube and a second-row tube spaced apart from each other at a predetermined interval in a width direction, the header tank comprising:

a header provided at one end of the first-row tube and one end of the second-row tube based on a longitudinal direction and comprising a first header part coupled to one end of the first-row tube, a second header part coupled to one end of the second-row tube, and a header central part configured to connect the first header part and the second header part;

a first tank coupled to the first header part to define a first internal space;

a second tank spaced apart from the first tank at a predetermined interval and coupled to the second header part to define a second internal space; and a plurality of communication pipes provided between the first tank and the second tank and configured to allow the first internal space and the second internal space to communicate with each other, wherein the plurality of communication pipes is disposed to be spaced apart from one another at predetermined intervals in the width direction, wherein first support insertion holes are formed at two opposite ends of a lower surface of the first header part based on the width direction, first supports protruding from a core part housing of the heat exchanger in a direction of the first header part are fixedly inserted into the first support insertion holes, second support insertion holes are formed at two opposite ends of a lower surface of the second header part based on the width direction, and second supports protruding from the core part housing of the heat exchanger in a direction of the second header part direction are fixedly inserted into the second support insertion holes.

* * * * *